United States Patent [19]

Matsuo et al.

[11] Patent Number: 4,592,706

[45] Date of Patent: Jun. 3, 1986

[54] INTERNAL GEAR PUMP WITH BRANCHED INTAKE PLENUM

[75] Inventors: Masashi Matsuo, Toyota; Yasushi Miura; Hideki Nakayoshi, both of Kariya, all of Japan

[73] Assignees: Toyota Jidosha Kabushiki Kaisha; Aisin Seiki Kabushiki Kaisha, both of Aichi, Japan

[21] Appl. No.: 776,838

[22] Filed: Sep. 17, 1985

[30] Foreign Application Priority Data

Sep. 27, 1984 [JP] Japan ..... 59-146385[U]

[51] Int. Cl.[4] ..... F01C 1/10; F01C 21/10

[52] U.S. Cl. ..... 418/171; 418/161

[58] Field of Search ..... 418/19-21, 418/160, 161, 164, 165, 166, 169, 170, 171

[56] References Cited

U.S. PATENT DOCUMENTS 2,513,984 7/1950 Witchger ..... 418/171

3,016,834 1/1962 Deska ..... 418/171

*Primary Examiner*—Leonard E. Smith

*Assistant Examiner*—Jane E. Obee

*Attorney, Agent, or Firm*—Parkhurst & Oliff

[57] ABSTRACT

This internal gear pump has: a pump housing formed with a rotor receiving cavity which has a cylindrical circumferential inner wall surface; an outer rotor formed with a generally cylindrical outer surface which fits closely and coaxially in the cylindrical circumferential inner wall surface of the rotor receiving cavity and is rotatable around their mutual central axis within the pump housing, and which is further formed with an inner cavity the defining surface of which is formed with a plurality of internally facing teeth; and an inner rotor, somewhat smaller than the inner cavity of the outer rotor, which is formed with a plurality of externally facing teeth which mesh and cooperate with the internally facing teeth of the outer rotor. A pumping chamber is defined between the outer surface of the inner rotor and the inner surface of the outer rotor between the mutually meshing teeth thereof. An aperture is formed in the pump housing to define an intake plenum, and this aperture opens to define an intake port structure through several portions of the circumferential inner wall surface of the rotor receiving cavity, at least one remaining portion of the circumferential inner wall surface of the rotor receiving cavity intervening between separate such several portions of the circumferential wall surface of the rotor receiving cavity which are removed to allow the intake port structure to open therethrough.

3 Claims, 2 Drawing Figures

INTERNAL GEAR PUMP WITH BRANCHED INTAKE PLENUM

BACKGROUND OF THE INVENTION

The present invention relates to the field of internal gear pumps for lubricating oil or the like, such as are suitable for use as lubricating pumps for internal combustion engines, and in particular to such an internal gear pump which has an improved intake plenum structure.

In the field of internal gear pumps for use as lubricating oil pumps or the like, there is a known type of pump which has: a pump housing formed with a cylindrical rotor receiving cavity; an outer rotor formed with a generally cylindrical outer surface which fits closely and coaxially in the cylindrical surface of the rotor receiving cavity and is rotatable therein around their mutual central axis within the pump housing, and further has an inner cavity the defining surface of which is formed with a plurality of internal teeth; and an inner rotor somewhat smaller than said inner cavity and fitted in it towards one side thereof, which is formed with a plurality of external teeth which mesh and cooperate with said internal teeth of said outer rotor. Thereby, a pumping chamber is defined between the outer surface of the inner rotor and the inner surface of the outer rotor, i.e. between the respective teeth and thereof. These teeth may be of trochoidal shape, or of involute or hypocycloid configuration. And, with regard to the porting structure of a conventional such pump, it is per se known for an aperture formed in the pump housing to define an intake plenum and to define an intake port by opening through a portion of the circumferential wall of the rotor receiving cavity and through a corresponding portion of the bottom thereof, thus opening to the pumping chamber. And, similarly, another aperture formed in the pump housing typically defines an output plenum, and defines an output port by opening through a portion of the circumferential wall of the rotor receiving cavity and through a corresponding portion of the bottom thereof, thus also opening to the pumping chamber.

When it is desired to improve the efficiency of such a pump, it is considered to be effective to increase the size of the intake port, i.e. to decrease its flow resistance, and to this end increasing the cross sectional area of the intake port is effective. However, if the size of the intake port is increased by increasing its depth, the problem arises in such a case that the axial dimension, i.e. the thickness, of the pump is unduly increased; while, on the other hand, if the size of the intake port is increased by increasing its width, the problem arises in such a case that the circumferential wall of the rotor receiving cavity is cut away over a large and localized area, thus creating the danger that the outer rotor may not be satisfactorily rotationally supported in said rotor receiving cavity by said circumferential wall thereof.

SUMMARY OF THE INVENTION

Accordingly, it is the primary object of the present invention to provide an internal gear pump which overcomes the above detailed problems.

It is a further object of the present invention to provide such an internal gear pump which has high efficiency.

It is a further object of the present invention to provide such an internal gear pump which has an intake port structure of low flow resistance.

It is a further object of the present invention to provide such an internal gear pump which has an efficient intake port structure, without compromising the mechanical structure of said pump.

It is a further object of the present invention to provide such an internal gear pump in which it is ensured that the outer rotor is well rotationally supported.

It is a yet further object of the present invention to provide such an internal gear pump which is not of undue axial extent.

It is a yet further object of the present invention to provide such an internal gear pump in which the circumferential wall of the rotor receiving cavity is not cut away over any large and localized area.

According to the most general aspect of the present invention, these and other objects are accomplished by An internal gear pump comprising: (a) a pump housing formed with a rotor receiving cavity which has a cylindrical circumferential inner wall surface; (b) an outer rotor formed with a generally cylindrical outer surface which fits closely and coaxially in said cylindrical circumferential inner wall surface of said rotor receiving cavity and is rotatable around their mutual central axis within said pump housing, and which is further formed with an inner cavity the defining surface of which is formed with a plurality of internally facing teeth; and (c) an inner rotor, somewhat smaller than said inner cavity of said outer rotor, which is formed with a plurality of externally facing teeth which mesh and cooperate with said internally facing teeth of said outer rotor; (d) a pumping chamber being defined between the outer surface of said inner rotor and the inner surface of said outer rotor between the mutually meshing teeth thereof; and (e) an aperture being formed in said pump housing to define an intake plenum, said aperture opening to define an intake port structure through several portions of said circumferential inner wall surface of said rotor receiving cavity, at least one remaining portion of said circumferential inner wall surface of said rotor receiving cavity intervening between separate such several portions of said circumferential wall surface of said rotor receiving cavity which are removed to allow said intake port structure to open therethrough.

According to such a structure, because the circumferential wall surface of the rotor receiving cavity is removed at several separated places, rather than at one large place, thereby, even if the total area of said circumferential wall surface which is removed is rather great, the secure rotational support of the outer rotor in said rotor receiving cavity by its said circumferential wall surface is not comprised. Accordingly, an internal gear pump is provided which overcomes the problems detailed above, and this internal gear pump has high efficiency, by having an intake port structure of low flow resistance. And this efficient intake port structure for the pump is provided without compromising the mechanical structure of said pump, and while ensuring that the outer rotor is well rotationally supported. Further, this is done without causing said internal gear pump to be of undue axial extent, and is accomplished by arranging that the circumferential wall of the rotor receiving cavity of the pump is not cut away over any large and localized area.

Further, according to a more particular aspect of the present invention, these and other objects are more particularly and concretely accomplished by an internal gear pump of the type defined above, wherein said at least one remaining portion of said circumferential inner wall surface of said rotor receiving cavity is formed with a surface which is cocylindrical with the main portion of said circumferential inner wall surface of said rotor receiving cavity and which aids to rotationally support said outer rotor.

According to such a structure, the proper support of said outer rotor in said pump housing is even more properly ensured, and the structural integrity of the pump is further promoted.

BRIEF DESCRIPTION OF THE DRAWINGS

The present invention will now be shown and described with reference to the preferred embodiment thereof, and with reference to the illustrative drawings. It should be clearly understood, however, that the description of the embodiment, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and spaces and so on are denoted by like reference symbols in the various figures thereof; in the description, spatial terms are to be everywhere understood in terms of the relevant figure; and:

DESCRIPTION OF THE PREFERRED EMBODIMENT

Figure 1:
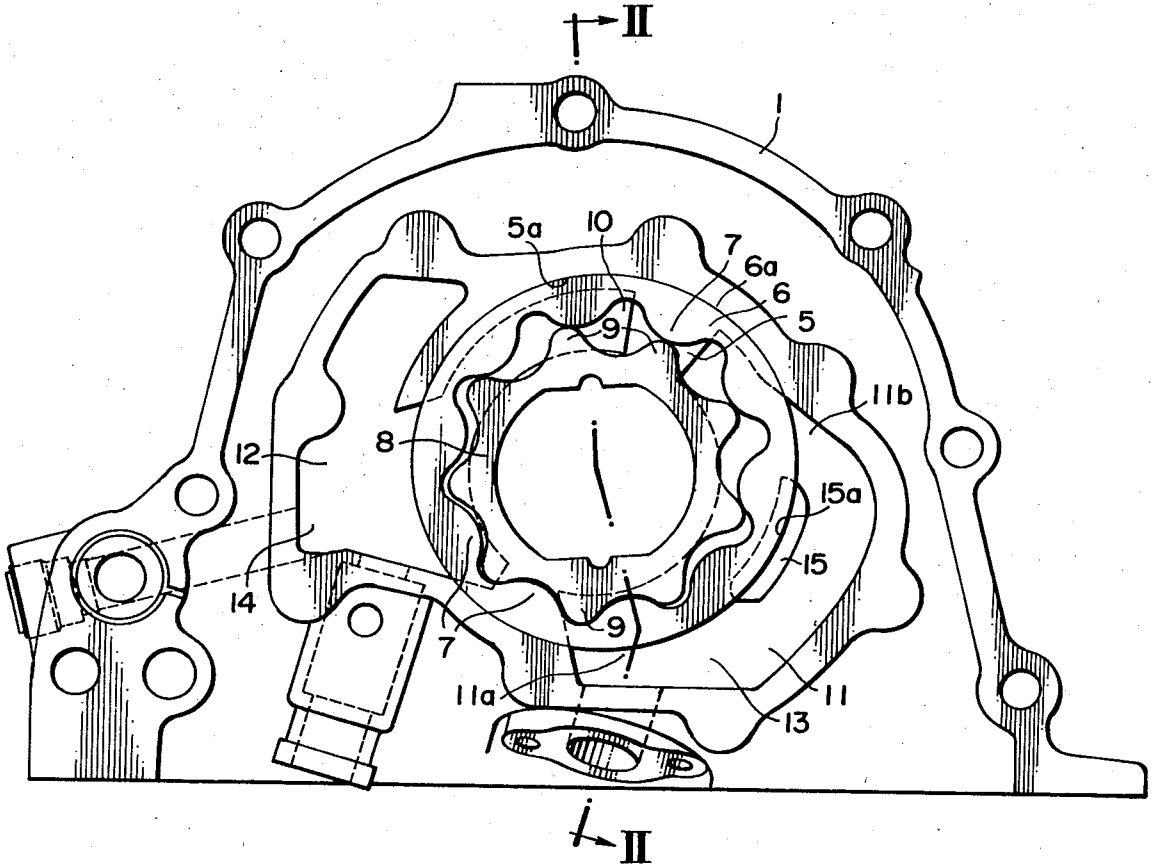
FIG. 1 is a plan view of the preferred embodiment of the internal gear pump of the present invention.
Figure 2:
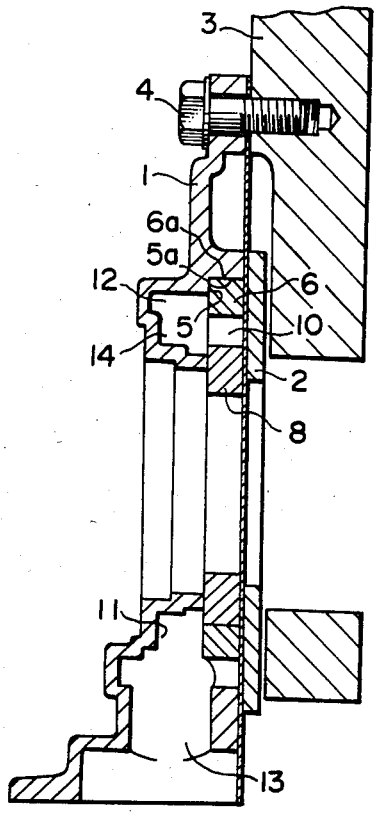
FIG. 2 is a vertical sectional view of said preferred embodiment, taken in a plane shown by the arrows II—II in FIG. 1.

The present invention will now be described with reference to the preferred embodiment thereof, and with reference to the appended drawings. FIG. 1 is a plan view of the preferred embodiment of the internal gear pump of the present invention, and FIG. 2 is a vertical sectional view of said preferred embodiment taken in a plane shown by the arrows II—II in FIG. 1. In these figures, the reference numeral 1 denotes the housing of the pump, which is fixed against a cylinder block 3 of an internal combustion engine by a plurality of bolts 4 (only one of which is shown) while sandwiching a backing plate 2 between itself and said cylinder block 3. In this pump housing 1 there is formed a rotor receiving cavity 5 which has a cylindrical surface 5*a*, and in said rotor receiving cavity 5 there is rotatably fitted an outer rotor 6.

This outer rotor 6 is formed with a generally cylindrical outer surface 6*a* which fits closely and coaxially in the cylindrical surface 5*a* of the rotor receiving cavity 5 and is rotatable therein around their mutual central axis within the pump housing 1, and further has an inner cavity the defining surface of which is formed with a plurality of internal teeth 7. In this inner cavity towards the one side thereof there is fitted an inner rotor 8, which is somewhat smaller than said inner cavity, and which is formed with a plurality of external teeth 9 which mesh and cooperate with said internal teeth 7 of said outer rotor 6. Thereby, a pumping chamber 10 is defined between the outer surface of the inner rotor 8 and the inner surface of the outer rotor 7, i.e. between the respective teeth 7 and 9 thereof. In the shown preferred embodiment of the present invention, the teeth 7 and 9 are of trochoidal shape, but, as will be clear to one of ordinary skill in the art based upon the descriptions herein, the present invention is equally applicable to the case of involute or hypocycloid configuration.

An aperture 11 formed in the pump housing 1 defines an intake plenum 13, and this aperture 11 opens through a portion of the circumferential wall of the rotor receiving cavity 5 and through a corresponding portion of the bottom thereof, thus opening to the pumping chamber 10 to define an intake port. And, similarly, another aperture 12 formed in the pump housing 1 defines an output plenum 14, and this aperture 12 similarly opens through a portion of the circumferential wall of the rotor receiving cavity 5 and through a corresponding portion of the bottom thereof, thus also opening to the pumping chamber 10 to define an output port. In more detail, with respect to the intake port, particularly according to the present invention, the portion of the aperture 11 defining it opens through the circumferential wall of the rotor receiving cavity 5 at two separated places, designated in FIG. 1 as 11*a* and 11*b*; and between these two openings 11*a* and 11*b* in said circumferential wall of said rotor receiving cavity 5 there remains a portion 15 of said circumferential wall which has an inner part cylindrical surface 15*a*.

When this gear pump is being used, the inner rotor 8 is driven to rotate in the counterclockwise rotational direction as seen in FIG. 1 about its own central axis by a shaft not particularly shown, and according to this the outer rotor 6 is likewise carried along to rotate about its own central axis in the counterclockwise rotational direction in the pump housing 1, and thereby fluid such as lubricating oil is sucked into the intake plenum 13, through the aperture 11, through the intake port structure, into the pumping chamber 10, and is compressed therein to a high pressure, then being ejected from said pumping chamber 10 through the output port, and through the aperture 12 and through the output plenum 14. During this action, the remaining portion 15 of the circumferential wall of the rotor receiving cavity 5 between the openings 11*a* and 11*b* which define the two separate portions of the intake port is very useful for helping the main portion 5*a* of the surface of said rotor receiving cavity 5 to support the rotation of the outer rotor 6 by pressing against the outer circumferential surface 6*a* of said outer rotor 6 with its surface 15*a*. Hence the support of the outer rotor 6 is reliably enforced, and it is made possible to make the size of the input port as a whole large, i.e. to ensure that said input port structure as a whole has a low flow resistance, without compromising the rotational support in the housing 1 of the outer rotor 6.

Although in the shown preferred embodiment the aperture 11 was formed with the two separate openings 11*a* and 11*b* opening through the circumferential wall surface 5*a* of the rotor receiving cavity 5 to define the intake port, with the one remaining portion 15 of said circumferential wall surface 5*a* being defined between said two openings 11*a* and 11*b*, in other possible embodiments it would be possible to have more than two such openings 11*a* and 11*b* for defining the intake port structure—in other words, to divide the aperture 11 into more than two portions and to have an intake plenum branched into more than two branches.

Thus it is seen that according to the present invention, because the circumferential wall surface 5*a* of the rotor receiving cavity 5 is removed at several separated places, i.e. at 11*a* and 11*b*, rather than at one large place as in the previously outlined prior art, thereby, even if the total area of said circumferential wall surface which is removed is rather great, the secure rotational support of the outer rotor 6 in said rotor receiving cavity 5 by its said circumferential wall surface 5*a* is not compromised. Accordingly, an internal gear pump is provided which overcomes the problems detailed earlier with relation to the prior art, and this internal gear pump has high efficiency, by having an intake port structure of low flow resistance. And this efficient intake port structure for the pump is provided without compromising the mechanical structure of said pump, and while ensuring that the outer rotor thereof is well rotationally supported. Further, this is done without causing said internal gear pump to be of undue axial extent, and is accomplished by arranging that the circumferential wall of the rotor receiving cavity of the pump is not cut away over any large and localized area.

Although the present invention has been shown and described with reference to the preferred embodiment thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown preferred embodiment, or of the drawings, but solely by the scope of the appended claims, which follow.

What is claimed is:

1. An internal gear pump comprising:

(a) a pump housing formed with a rotor receiving cavity which has a cylindrical circumferential inner wall surface;

(b) an outer rotor formed with a generally cylindrical outer surface which fits closely and coaxially in said cylindrical circumferential inner wall surface of said rotor receiving cavity and is rotatable around their mutual central axis within said pump housing, and which is further formed with an inner cavity the defining surface of which is formed with a plurality of internally facing teeth; and (c) an inner rotor, somewhat smaller than said inner cavity of said outer rotor, which is formed with a plurality of externally facing teeth which mesh and cooperate with said internally facing teeth of said outer rotor;

(d) a pumping chamber being defined between the outer surface of said inner rotor and the inner surface of said outer rotor between the mutually meshing teeth thereof; and (e) an aperture being formed in said pump housing to define an intake plenum, said aperture opening to define an intake port structure through several portions of said circumferential inner wall surface of said rotor receiving cavity, at least one remaining portion of said circumferential inner wall surface of said rotor receiving cavity intervening between separate such several portions of said circumferential wall surface of said rotor receiving cavity which are removed to allow said intake port structure to open therethrough.

2. An internal gear pump according to claim 1, wherein said at least one remaining portion of said circumferential inner wall surface of said rotor receiving cavity is formed with a surface which is co-cylindrical with the main portion of said circumferential inner wall surface of said rotor receiving cavity and which aids to rotationally support said outer rotor.

3. An internal gear pump according to claim 1, wherein said aperture opens through exactly two separate portions of said circumferential inner wall surface of said rotor receiving cavity, with exactly one remaining portion of said circumferential inner wall surface of said rotor receiving cavity intervening between said two separate portions of said circumferential wall surface of said rotor receiving cavity which are removed to allow said intake port structure to open therethrough.

* * * * *